United States Patent [19]

Bell

[11] 4,099,698

[45] Jul. 11, 1978

[54] APPARATUS AND METHOD FOR HANGING AND ORIENTING A WALL HANGING

[76] Inventor: Henry O. Bell, 3758 E. 113th Ave., Thornton, Colo. 80233

[21] Appl. No.: 749,414

[22] Filed: Dec. 10, 1976

[51] Int. Cl.[2] ..... A47G 1/16

[52] U.S. Cl. ..... 248/493; 248/494

[58] Field of Search ..... 248/495, 496, 497, 498, 248/493, 494, 490, 491, 489, 468, 476, 477, 475; 24/115 J, 118, 127, 129 R

[56] References Cited

U.S. PATENT DOCUMENTS

| | | | |
|---|---|---|---|
| 370,765 | 10/1887 | Campbell | 248/493 |
| 415,283 | 11/1889 | Riley | 24/115 J |
| 533,603 | 2/1895 | McEvoy | 24/115 J |
| 1,470,261 | 10/1923 | Harrington | 24/127 |
| 3,138,359 | 6/1964 | Stewart | 248/490 |

FOREIGN PATENT DOCUMENTS

| | | | |
|---|---|---|---|
| 11,565 of | 1908 | United Kingdom | 24/115 J |
| 333,983 | 8/1930 | United Kingdom | 248/489 |

*Primary Examiner*—Marion Parsons, Jr.
*Attorney, Agent, or Firm*—Gary M. Polumbus

[57] ABSTRACT

The apparatus and method for hanging a wall hanging from a wall surface causes the wall hanging to return to a desired orientation if it is disturbed. The apparatus and method generally involves a pair of knob members mounted at a wall surface in a spaced apart and generally protruding relation, a suspension cable means having its center portion looped in at least one complete loop around the knob members for attachment to the lower marginal border area or frame of the wall hanging, and a connecting member extending between the looped center portion of the cable suspension means to the upper marginal border area or frame of the wall hanging.

20 Claims, 4 Drawing Figures

APPARATUS AND METHOD FOR HANGING AND ORIENTING A WALL HANGING

BACKGROUND AND SUMMARY OF THE INVENTION

This invention relates to an apparatus and method for hanging a picture or other wall hanging or object on a wall surface to cause the wall hanging, once leveled or set to a desired orientation, to return to the desired orientation if it is accidentally disturbed.

Certain apparatus for maintaining a wall hanging in a straight or level condition are known in the art, for example U.S. Pat. No. 2,657,887, but such apparatus generally tends to be relatively complex in construction, difficult to use, expensive in cost, and not always as effective as desired.

It is therefore an object of this invention to provide an apparatus and a method of hanging a wall hanging that will cause the wall hanging to return to its desired original orientation if it is accidentally disturbed.

In certain cases a more pleasing appearance of the wall hanging may be obtained by tilting it slightly downward as by moving the top of the wall hanging outward from the wall surface. Accordingly, it is a further objective of this invention to provide an apparatus and a method which allows a wall hanging to assume a desired angle or downward tilt with respect to the wall surface on which it hangs.

It is still another object of this invention to provide an apparatus and a method for hanging a wall hanging on a surface at a desired downward tilt with respect to the wall such that the wall hanging will effectively return to its initial desired orientation if it is disturbed.

Other objects of the invention are to provide apparatus for hanging a wall hanging which is relatively easy and convenient to install on a wall surface and to use in conjunction with the wall hanging, and which is relatively inexpensive in cost.

The present invention may be fully understood from the following claims, description of the preferred embodiment and brief description of the drawing.

Summarizing the apparatus of the present invention, it will be seen to comprise a pair of knob members, means for mounting the knob members at the wall surface generally in an outward protruding and spaced apart relation, a suspension means for suspending the wall hanging from its lower marginal border area and comprising a cable means for encircling the pair of knob members in at least one complete loop, and connecting means for connecting the wall hanging at its upper marginal border area to the cable means intermediate the pair of knob members or in other words, operatively to the wall surface. The method of the present invention may generally comprise the steps of mounting a pair of knob members at the wall surface in a spaced apart relation slightly less than the width of the wall hanging, looping the middle portion of a suspension cable around the pair of knob members in at least one complete loop, extending one end portion of the suspension cable generally downward from each knob member, attaching each end portion of the suspension cable to the lower marginal border area of the wall hanging at laterally opposite positions, and connecting the wall hanging from its upper marginal border area to the middle portion of the suspension cable between the knob members or in other words, operatively to the wall surface.

DESCRIPTION OF THE PREFERRED EMBODIMENT

Figure 1:
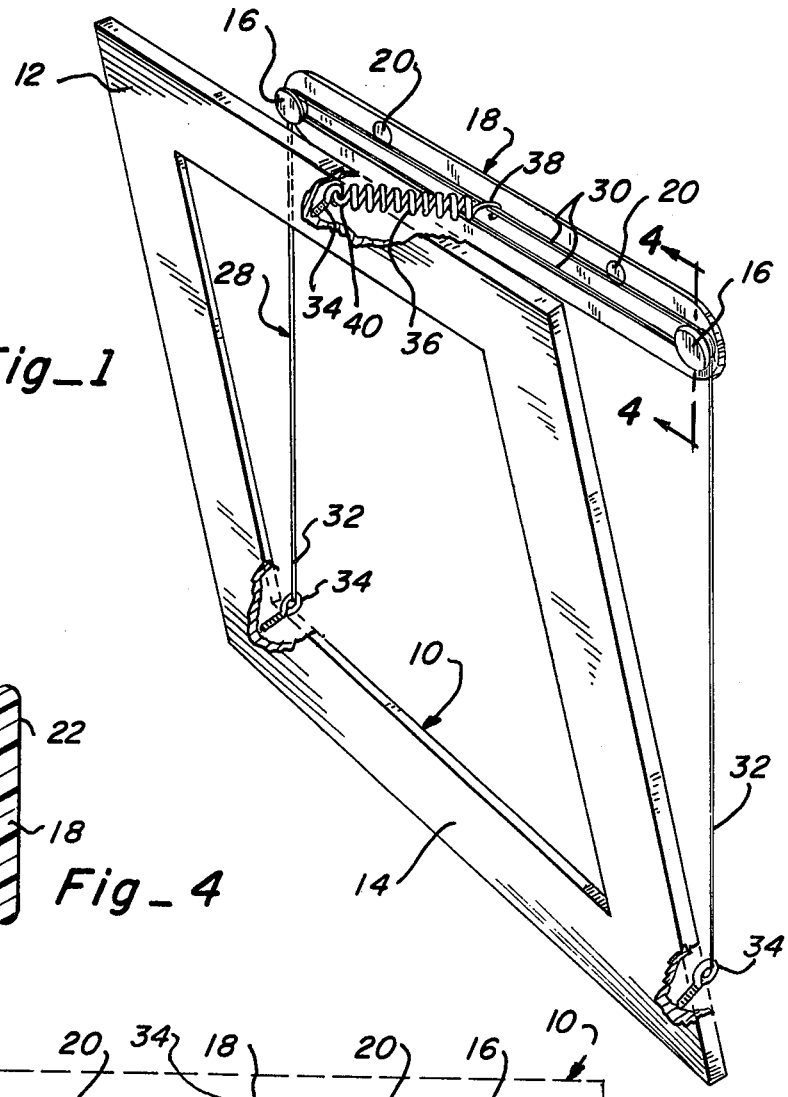
FIG. 1 is a perspective view of the present invention in conjunctive use with an exemplary wall hanging.
Figure 2:
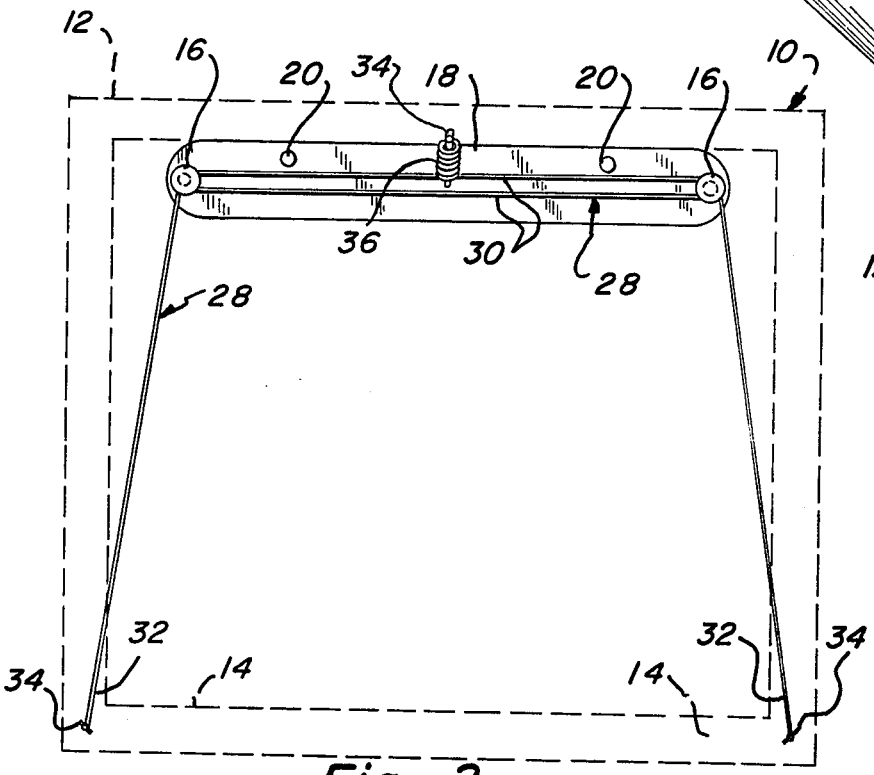
FIG. 2 is a front elevational view of the present invention in use in conjunction with a wall hanging shown in phantom.
Figure 3:
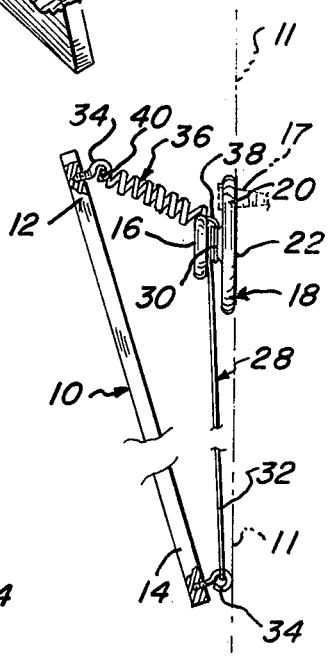
FIG. 3 is a side elevational view of the present invention in use in mounting an exemplary wall hanging on a wall surface as shown in phantom.

Referring now to FIGS. 1, 2 and 3 of the drawing there is shown apparatus for attaching a wall hanging, represented by a frame 10, to a wall surface 11 (FIG. 3). The wall hanging may take the form of a conventional picture having the frame 10, or may take any other form. The frame 10 is one example of a marginal border area of the wall hanging and includes an upper marginal border area 12 and a lower marginal area 14. In situations where a frame is not present, the edge area of the wall hanging itself will provide the marginal border area.

Figure 4:
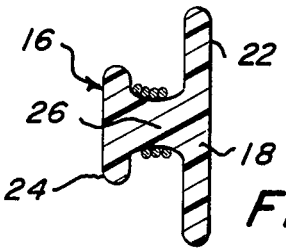
FIG. 4 is a sectional view taken along line 4—4 of FIG. 1.

The apparatus of the present invention comprises a pair of knob members, each referenced 16, and an elongated wall bracket member 18 attached to the pair of knob members. The wall bracket member 18 includes openings 20 through which screws 17 (FIG. 3) or other fastening devices may be passed to attach the knob members 16 and bracket member 18 to the wall surface. A back surface 22 of bracket member 18 is generally planar to allow it to fit flat against the wall surface. The knob members 16 are securely fastened to the bracket member 18 such as by glue or the knob members and bracket member may be formed from a single piece of material such as plastic; as shown in FIG. 4.

Each knob member is generally symmetrical about an axis therethrough and comprises an outer circular lip portion 24 and center cylindrical barrel portion 26 of reduced diameter relative to the circular lip portion 24. When attached to the bracket member 18, the central axis of the knob member 16 protrudes outwardly from the bracket member 18 preferably perpendicularly to the back surface 22 and the wall surface. The bracket member 18 thus comprises one form of means for mounting the pair of knob members at the wall surface generally in an outward protruding and spaced apart relationship. As is shown in FIG. 2, it is desirable that the knob members assume a horizontally spaced apart relationship, which can be achieved by attaching the wall bracket member 18 generally horizontally on the wall surface.

Suspension means for suspending the wall hanging at its lower marginal border area 14 from the pair of knob members 16 also comprises a portion of the apparatus.

The suspension means may take the form of a cable member 28 having a middle portion 30 and two end portions each referenced 32. The middle portion 30 of the cable means is adapted for looping between or encircling the pair of knob members 16 to provide at least one complete loop around the knob members. Each complete loop around the knob members 16 is defined by extension of the cable member from a point on the cylindrical barrel portion 26 of one knob member 16 over the cyclindrical portion of the other knob member and back to the starting position at the cylindrical portion 26 of the first knob member. One end portion 32 of the cable member 28 depends from each knob member 16 and extends downwardly from that knob member to the lower marginal border area 14 of the wall hanging or the lateral edge of the wall hanging vertically closest below the knob member 16. Means for attaching the end portions 32 of the cable member 28 to the wall hanging at laterally opposite positions on the lower marginal border area 14 are provided in the form of eye screws 34 to which the end portions 32 may be connected or tied. In practice, an additional fractional part of a complete loop of the middle portion 30 of the cable member 28 will always exist between the knob members 16 since each cable end portion 32 depends from a different knob member.

The apparatus of the present invention also includes connecting means for connecting the wall hanging at an upper marginal border area 12 to the middle portion 30 of the cable member 28 intermediate the pair of knob members 16, and such means may take the form of a connecting member 36, such as a resilient coil spring member. A hooked-shaped end portion 38 of connecting member 36 serves as one form of means for connecting one end portion of the connecting member 36 to the middle portion 30 of the cable member 28 at the approximate mid-point between the knob members 16. Another eye screw 34 is one form of means for attaching the other end of the connecting member 36, which may also be hooked-shaped, to the upper marginal border area 12 at a position approximately vertically above the mid-point between the points of attachment of the end portions 32 to the lower marginal border area 14. Each of the eye screws is screwed into the frame or otherwise attached to the wall hanging. The connecting member is thus one form of means for operatively connecting the upper marginal border area of the wall hanging to the wall surface.

In use, the pair of knob members 16 is mounted on the wall surface by the wall bracket 18 or other suitable mounting means. The distance between the knob members is selected to be slightly less than the width of the wall hanging, as is shown in FIG. 2. The middle portion 30 of the cable member 28 is looped preferably in a plurality of loops between the pair of knob members, and one end portion 32 of the cable member 28 is caused to extend generally downward from each knob member. The end portions 32 of the cable member are attached to the lower marginal border area of the wall hanging at horizontally spaced positions, as by means of the eye screws. At a position essentially centered between and vertically above the attachment positions of the cable ends 32, the wall hanging is connected to the middle portion 30 of the cable member 28 between the knob members 16 by the connecting member 36. The wall hanging is leveled or set to a desired orientation by lifting the lower edge of the wall hanging and pulling downward at an appropriate location on the opposite upper edge of the wall hanging to cause the middle portion 30 of the suspension cable to slide around the center cylindrical portions 26 of the knob members 16 until the desired orientation is obtained. The connecting member 36 holds the upper portion of the wall hanging slightly outward from the wall surface thereby providing a desired degree of tilt with respect to the wall surface.

If the wall hanging should be accidently bumped or otherwise inadvertantly disturbed, the weight of the wall hanging and the resistance of the coils or loops around the knob members prevent the loops of the middle portion 30 of the cable member 28 from slipping around the cylindrical portions of the knob members, thereby maintaining the picture in its desired orientation. The wall hanging may move slightly from side to side when disturbed but the desired orientation is not changed when the movement stops. Greater resistance to slipping by each loop of the cable middle portion around the knob member 16 is obtained by additional numbers of loops of the cable middle portion around the knob members, but generally three loops of the cable middle portion around the knob members is sufficient.

The preferred embodiment of the invention has been described with particularity so as to enable its clear understanding. However, the scope of the present invention is intended to be limited only according to the inventive concepts expressed by the following claims and only insofar as the prior art requires.

What is claimed is:

1. Apparatus for attaching a wall hanging having a marginal border area to a wall surface, comprising:

a pair of knob members;

means for mounting said knob members at the wall surface generally in an outward protruding and laterally spaced apart relation;

suspension means for suspending the wall hanging at a lower marginal border area from said pair of knob members, said suspension means comprising flexible cable means for encircling said pair of knob members collectively in at least one complete and continuous loop; and connecting means for operatively connecting the wall hanging at an upper marginal border area to the wall surface.

2. Apparatus as recited in claim 1 wherein said means for mounting said knob members comprises an elongated wall bracket member attached to said pair of knob members.

3. Apparatus as recited in claim 2 wherein said wall bracket member is adapted to operatively mount said pair of knob members to the wall surface in a generally horizontal spaced apart relation.

4. Apparatus as recited in claim 1 wherein said connecting means connects the wall hanging at an upper marginal border area thereof to the cable means between said pair of knob members.

5. Apparatus as recited in claim 1 wherein the cable means of said suspension means comprises a cable member having a middle portion and two end portions, the middle portion adapted for looping between said pair of knob members and each end portion adapted for depending from one of said knob members.

6. Apparatus as recited in claim 5 wherein said connecting means comprises a connecting member having two end portions, one end portion adapted for operative connection to the middle portion of the cable member intermediate said pair of knob members, and the other end portion adapted for operative connection to the upper marginal border area of the wall hanging.

7. Apparatus as recited in claim 6 further comprising means for attaching the end portions of the cable member to the wall hanging at laterally opposite positions on the lower marginal border area of the wall hanging.

8. Apparatus as recited in claim 6 wherein the connecting member comprises a resilient member.

9. Apparatus for attaching a wall hanging having a marginal border area to a wall surface, comprising:

a pair of knob members;

means for operatively mounting said pair of knob members at the wall surface generally in an outward protruding and horizontally spaced apart relation;

a flexible cable member having a middle portion and two end portions, the middle portion being adapted for encircling said pair of knob members collectively in at least one complete and continuous loop, and each end portion adapted for extending downward from an associated knob member to laterally opposite positions on the lower marginal border area of the wall hanging;

a connecting member adapted for extending from the middle portion of the cable member intermediate the knob members to an upper marginal border area of the wall hanging;

means for connecting one end portion of the connecting member to the middle portion of the cable member at the approximate midpoint between the knob members; and means for attaching the end portions of the cable member to the lower marginal border area of the wall hanging at laterally opposite positions, and for attaching the other end of the connecting member to the upper marginal border area at a position essentially vertically above the approximate midpoint between the laterally opposite attachment position of the end portions of cable member.

10. Apparatus as recited in claim 9 wherein said means for operatively mounting said pair of knob members at the wall surface comprises a wall bracket member attached to said pair of knob members.

11. Apparatus as recited in claim 10 wherein said pair of knobs are separated by a distance less than the width of the wall hanging.

12. Apparatus as recited in claim 9 wherein said attaching means comprise screw members.

13. Apparatus as recited in claim 12 wherein the screw members comprise eye screws.

14. Apparatus as recited in claim 9 wherein the middle portion of the cable member is adapted for encircling both knob members in at least a plurality of complete loops.

15. An improved method of hanging a wall hanging having a marginal border area from a wall surface, comprising the steps of:

providing a pair of knob members at the wall surface to project outward therefrom to be horizontally spaced apart slightly less than the width of the wall hanging;

looping the middle portion of the suspension cable around the pair of knob members collectively in at least one complete and continuous loop;

extending one end portion of the suspension cable generally downward from each knob member;

attaching each end portion of the suspension cable to the lower marginal border area of the wall hanging generally at opposite laterally spaced positions; and operatively connecting the wall hanging from a position essentially vertically centered above the attachment positions of the suspension cable ends to the wall surface.

16. A method as recited in claim 15 further comprising the step of:

connecting the wall hanging from the essentially vertically centered position to the middle portion of the suspension cable at an essentially centered position between the knob members.

17. A method as recited in claim 16 further comprising the step of:

looping the middle portion of the suspension cable around the pair of knob members in a plurality of complete loops.

18. Apparatus for attaching a wall hanging having a marginal border area to a wall surface, comprising:

protrusion means for protruding outward of a wall surface and providing two laterally spaced apart flexible cable receiving portions, suspension means for suspending the wall hanging at a lower marginal border area from the cable receiving portions of said protrusion means, said suspension means comprising cable means for extending collectively around the cable receiving portions of said protrusion means in at least one complete and continuous loop, and connecting means for operatively connecting the wall hanging at an upper marginal border area to the wall surface.

19. Apparatus as recited in claim 18 wherein the cable receiving portions of said protrusion means are curvilinearly shaped.

20. Apparatus as recited in claim 19 wherein: said protrusion means comprises a pair of knob members mounted at the wall surface; and the cable receiving portions of said protrusion means comprises curved barrel portions of each knob member.

* * * * *